US011369134B2

(12) United States Patent
Lockwood

(10) Patent No.: US 11,369,134 B2
(45) Date of Patent: Jun. 28, 2022

(54) APPARATUSES AND METHODS FOR FILLING AND PACKING HERB RECEPTACLES WITH HERB MATERIAL

(71) Applicant: Gevorg Gabrielyan, Van Nuys, CA (US)

(72) Inventor: Alexander T. Lockwood, Port Townsend, WA (US)

(73) Assignee: Gevorg Gabrielyan, Van Nuys, CA (US)

( * ) Notice: Subject to any disclaimer, the term of this patent is extended or adjusted under 35 U.S.C. 154(b) by 261 days.

(21) Appl. No.: 16/676,277

(22) Filed: Nov. 6, 2019

(65) Prior Publication Data

US 2020/0146336 A1 May 14, 2020

Related U.S. Application Data

(60) Provisional application No. 62/760,740, filed on Nov. 13, 2018.

(51) Int. Cl.
*A24C 5/02* (2006.01)
*A24C 5/39* (2006.01)

(52) U.S. Cl.
CPC ..... *A24C 5/02* (2013.01); *A24C 5/393* (2013.01); *A24C 5/397* (2013.01)

(58) Field of Classification Search
CPC ..... A24C 5/02
See application file for complete search history.

(56) References Cited

U.S. PATENT DOCUMENTS

| | | | | |
|---|---|---|---|---|
| 45,575 | A | 12/1864 | Berg | |
| 190,541 | A | 5/1877 | Bromwell | |
| 361,248 | A | 4/1887 | Winton | |
| 1,364,360 | A | 1/1921 | Emery | |
| 1,724,735 | A | 8/1929 | Selbach | |
| 3,534,424 | A | 10/1970 | Levinson | |
| 5,400,466 | A | 3/1995 | Alderman et al. | |
| 6,549,860 | B1 | 4/2003 | Lillard | |
| 10,154,686 | B2 | 12/2018 | Heidtmann | |
| 2003/0234332 | A1 | 12/2003 | Yen et al. | |
| 2007/0107738 | A1 | 5/2007 | Barnes et al. | |
| 2011/0114104 | A1 | 5/2011 | Demmer et al. | |
| 2012/0055495 | A1 | 3/2012 | Dahan et al. | |
| 2016/0120212 | A1 | 5/2016 | Heidtmann | |
| 2019/0150500 | A1* | 5/2019 | Dueweke | A24C 5/42 |
| 2019/0320708 | A1* | 10/2019 | Boucher | A24C 5/54 |
| 2020/0015516 | A1* | 1/2020 | Simpson | A24D 1/20 |

FOREIGN PATENT DOCUMENTS

| | | |
|---|---|---|
| DE | 36 05 052 | 8/1987 |
| DE | 8711945 | 9/1987 |
| WO | 02/056714 | 7/2002 |

* cited by examiner

*Primary Examiner* — Cynthia Szewczyk

(74) *Attorney, Agent, or Firm* — Seed IP Law Group LLP

(57) ABSTRACT

Apparatuses and methods are provided for filling and packing herb receptacles with herb material. For example, a method of filling and packing herb receptacles is provided which includes supporting the herb receptacles in space on a vibrating platform with the aid of a support structure having a plurality of holding apertures; dosing herb material into the herb receptacles; repositioning the vibrating platform from a loading configuration to a packing configuration to lift the herb receptacles with the herb material relative to the support structure; and packing the herb receptacles with the herb material with the vibrating platform in the packing configuration.

24 Claims, 14 Drawing Sheets

APPARATUSES AND METHODS FOR FILLING AND PACKING HERB RECEPTACLES WITH HERB MATERIAL

CROSS-REFERENCE TO RELATED APPLICATIONS

This application claims the benefit of U.S. Provisional Application No. 62/760,740, filed Nov. 13, 2018, the entire contents of which are hereby incorporated by reference herein.

BACKGROUND

Technical Field

This disclosure generally relates to apparatuses for filling and packing receptacles and related methods. In particular, but not exclusively, the disclosure relates to apparatuses for filling and packing tubular herb receptacles with herb material and related methods.

Description of the Related Art

Paper, cellulose or hemp tubular receptacles are often filled by processed plant material, such as an herb mixture, to allow it to be set alight so that it can be smoked. Traditionally, tubular receptacles (e.g., paper cones) have been filled manually by inserting an amount of herb mixture into the tubular receptacle and thereafter packing the mixture by striking the tubular receptacle on a hard surface until a desired density is obtained. This manual process of filling and packing tubular receptacles is laborious and time consuming.

Different apparatuses have been suggested to address the shortcomings of the manual filling process. For example, US Patent Publication No. 2016/0120212 discloses a filling apparatus for simultaneously filling and packing a plurality of tubular receptacles with herb material. Such apparatuses, however, may be overly complex or suffer from various other deficiencies and drawbacks.

BRIEF SUMMARY

Embodiments described herein provide apparatuses and related methods for filling and packing herb receptacles with herb material in a particularly efficient manner.

According to one example embodiment, an apparatus for filling and packing herb receptacles with herb material may be summarized as including: a base assembly having a vibrating platform that is movable between a loading configuration and a packing configuration; a holding tray positionable over the base assembly and having a plurality of holding tray apertures each sized to receive a respective herb receptacle and to encircle the herb receptacle at an intermediate location along a longitudinal length of the herb receptacle; and a loading tray removably coupled to the holding tray and having a plurality of loading tray apertures each sized to receive a respective herb receptacle and to encircle the herb receptacle at an upper location along a longitudinal length of the herb receptacle.

The apparatus may further comprise a metering device removably coupled to the loading tray and having a plurality of metering cavities for receiving a respective dose of the herb material. The metering device may be movable relative to the loading tray to enable the respective dose of the herb material to be selectively deposited in a respective herb receptacle when moving the metering device from a fill configuration, in which the metering cavities are isolated from internal cavities of the receptacles, to a deposit configuration, in which the metering cavities are open to the internal cavities of the herb receptacles. The metering device may include a gate structure that is slidable relative to the loading tray to enable the respective dose of the herb material to be selectively deposited into the respective herb receptacle when moving from the fill configuration to the deposit configuration. The metering device may be removably supported on the loading tray to enable removal of the metering device from the loading tray prior to packing the herb receptacles with the herb material. The apparatus may further include one or more supplemental metering plates positionable on the metering device to adjust a dose volume of the herb material to be deposited in the herb receptacles. Each supplemental metering plate may include a plurality of metering apertures alignable with the metering cavities of the metering device to effectively increase a dose volume of the metering cavities.

The base assembly of the apparatus may include a base structure and the vibrating platform may be movably coupled to the base structure to enable movement of the vibrating platform between the loading configuration and the packing configuration. For example, the vibrating platform may be movably coupled to the base structure via a user manipulable lift arrangement. The user manipulable lift arrangement may include a plurality of cams and at least one linkage member.

When the vibrating platform of the base assembly is in the loading configuration, the loading tray and holding tray may support the herb receptacles with terminal ends of the herb receptacles in contact with the vibrating platform and with loading ends of the herb receptacles at or below an upper surface of the loading tray. Conversely, when the vibrating platform of the base assembly is in the packing configuration, the loading tray and holding tray may support the herb receptacles with terminal ends of the herb receptacles in contact with the vibrating platform and with loading ends of the herb receptacles above the upper surface of the loading tray.

The vibrating platform may be configured to move the herb receptacles relative to the holding tray and the loading tray when moving from the loading configuration to the packing configuration.

The base assembly of the apparatus may further include an electric vibrator fixed to the vibrating platform to enable selective vibration of the vibrating platform during packing of the herb receptacles. A frequency and/or an intensity of the electric vibrator may be variable to adjust a packing quality of the herb receptacles.

In some instances, the loading tray may be removably supported above and spaced apart from the holding tray. The loading tray apertures may be aligned coaxially with the holding tray apertures via a plurality of alignment guides. The loading tray may be spaced apart from the holding tray such that a mid-section of the herb receptacles are visible when filling and packing the herb receptacles with the herb material. Each loading tray aperture may be sized to closely encircle the herb receptacle at the upper location along the longitudinal length of the herb receptacle to minimize an amount of herb material bypassing the herb receptacle during filling.

The holding tray may be configured to independently support the herb receptacles when removed from the base assembly. For example, in some instances, each holding tray aperture may be sized to engage a portion of the herb receptacle at a location above the intermediate location when lifting the holding tray with the herb receptacles received therein such that the holding tray may be used to carry the herb receptacles.

According to another example embodiment, a method of filling and packing herb receptacles with herb material may be summarized as including: supporting the herb receptacles in space on a vibrating platform with the aid of a support structure having a plurality of holding apertures each sized to receive a respective one of the herb receptacles and to encircle the herb receptacle at an intermediate location along a longitudinal length of the herb receptacle; dosing herb material into the herb receptacles; repositioning the vibrating platform from a loading configuration to a packing configuration to lift the herb receptacles with the herb material relative to the support structure; and packing the herb receptacles with the herb material with the vibrating platform in the packing configuration.

The method may further include, during the dosing of the herb material into the herb receptacles, supporting the herb receptacles in space on the vibrating platform with the further aid of a loading tray.

Dosing the herb material into the herb receptacles may include filling a plurality of metering cavities of a metering device with the herb material and translating the metering device relative to the loading tray to expose the metering cavities to internal cavities of the herb receptacles.

The method may further include removing the metering device from the loading tray prior to repositioning the vibrating platform from the loading configuration to the packing configuration.

The method may further include, after packing the herb receptacles with the herb material, removing the loading tray from support of the herb receptacles and relocating the support structure with the herb receptacles with the packed herb material supported therein for further processing.

The method may further include adjusting a packing quality of the herb material in the herb receptacles by modifying a frequency and/or an intensity of vibratory motion of the vibrating platform during the packing of the herb receptacles.

DETAILED DESCRIPTION

In the following description, certain specific details are set forth in order to provide a thorough understanding of various disclosed embodiments. However, one of ordinary skill in the relevant art will recognize that embodiments may be practiced without one or more of these specific details. In other instances, well-known devices, systems and processes associated with filling and packing herb receptacles with herb material may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide apparatuses and related methods for filling and packing herb receptacles with herb material in a particularly efficient manner.

FIGS. 1 through 11 show one example embodiment of an apparatus for filling and packing herb receptacles with herb material, and FIGS. 12A through 12K provide a sequence of images of such an apparatus during use and illustrate aspects of methods of filling and packing herb receptacles with herb material according to embodiments of the present invention.

With reference to FIGS. 1 through 11, an apparatus 10 for filling and packing herb receptacles 12 with herb material 14 is provided according to one example embodiment.

Figure 8:
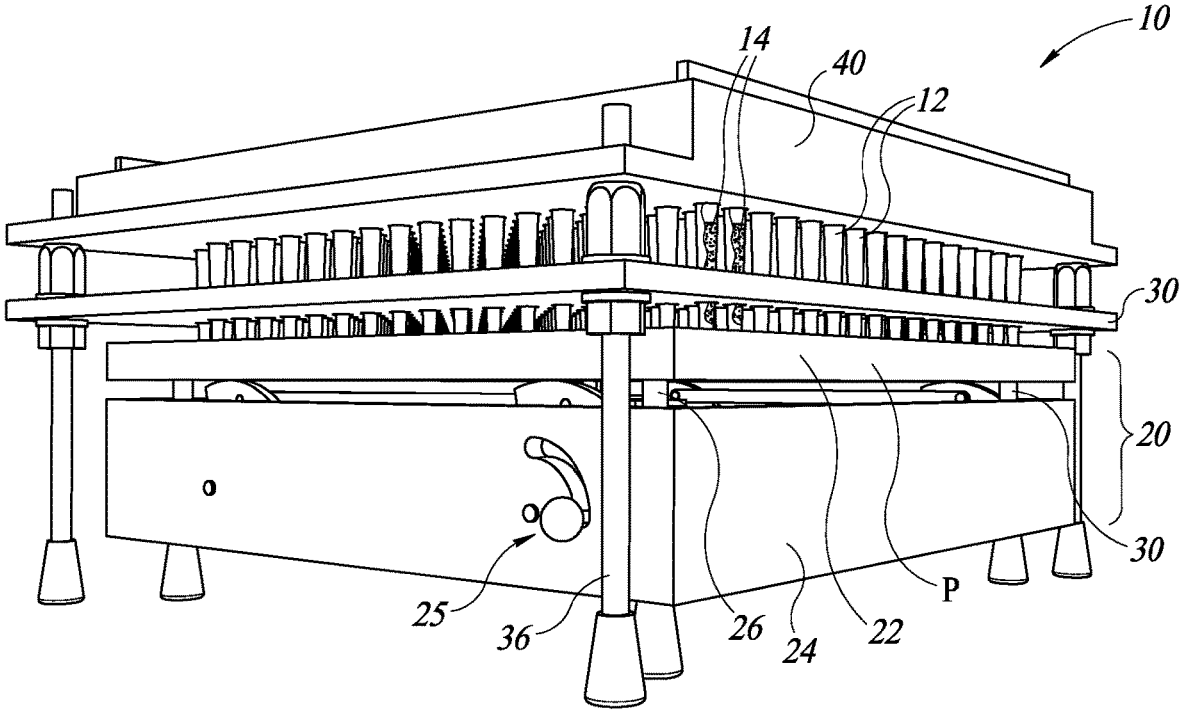
FIG. 8 shows an enlarged perspective view of the apparatus of FIG. 1 loaded with the plurality of herb receptacles, and wherein the herb receptacles are shown filled with multiple doses of herb material.
Figure 9:
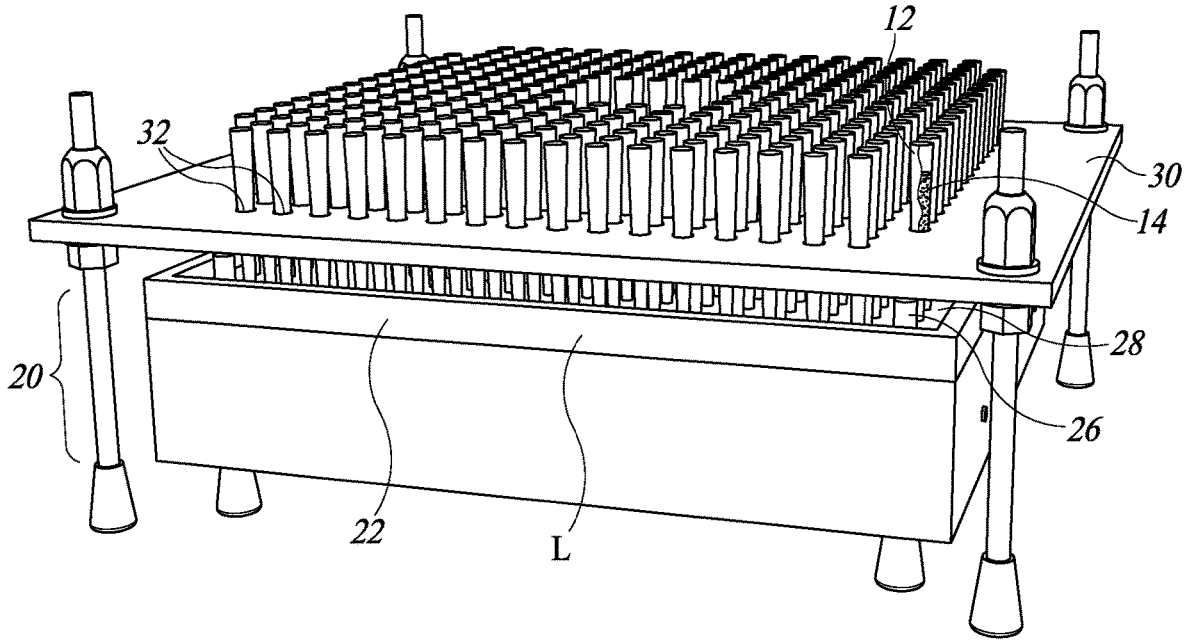
FIG. 9 shows an enlarged perspective view of the apparatus of FIG. 1 loaded with the plurality of herb receptacles, wherein the herb receptacles are shown filled with multiple doses of herb material, and wherein a loading tray of the apparatus has been removed to provide access to the filled herb receptacles.
Figure 10:
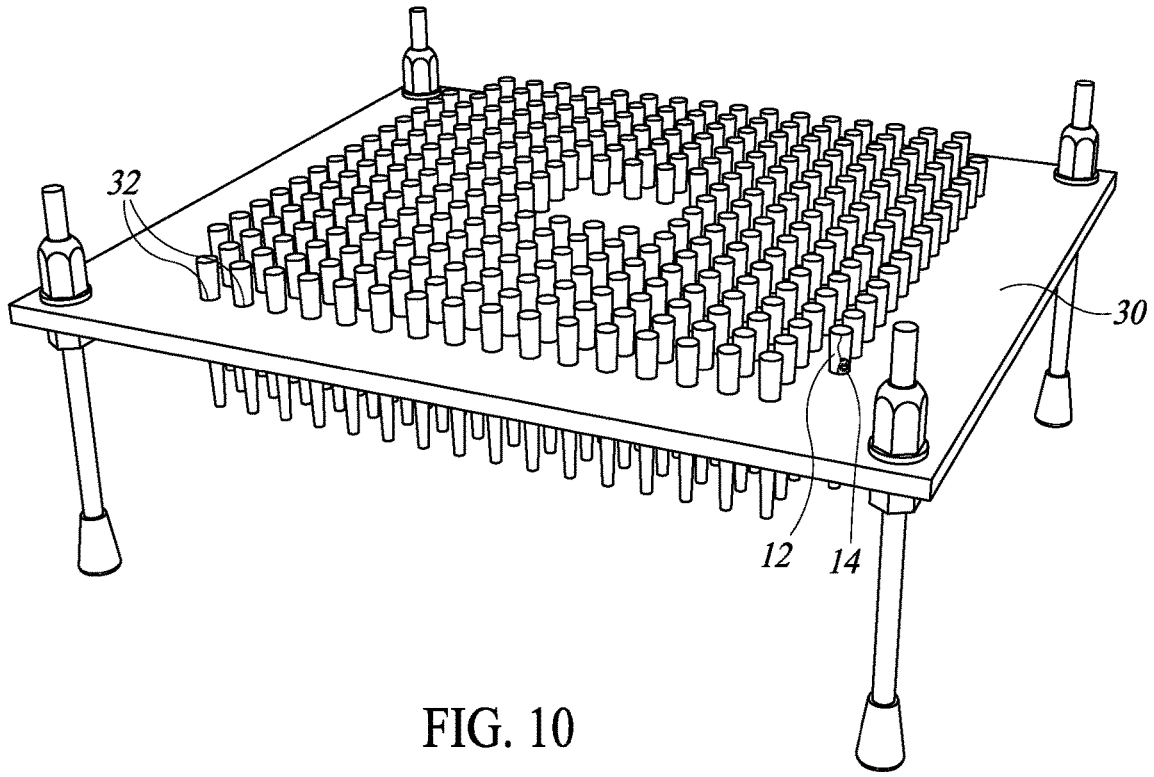
FIG. 10 shows a perspective view of a holding tray of the apparatus of FIG. 1 loaded with the plurality of filled herb receptacles.
Figure 11:
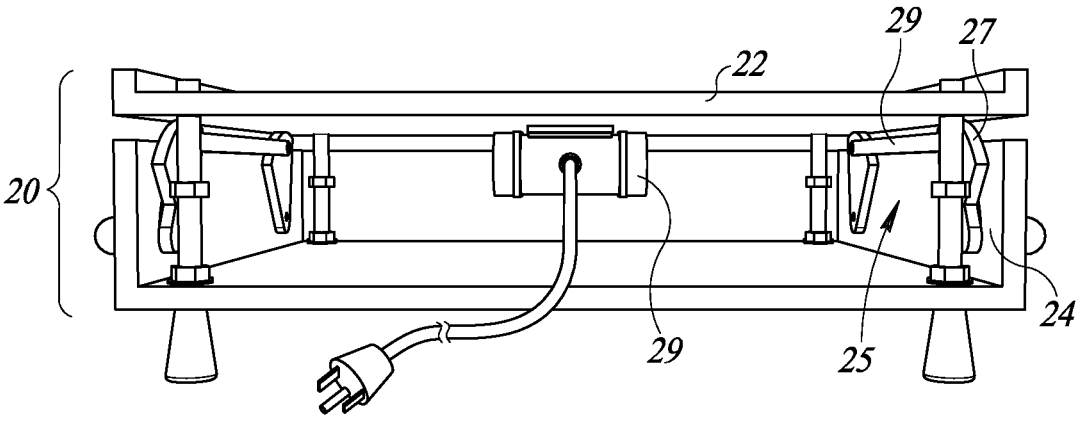
FIG. 11 shows a rear perspective view of a base assembly of the apparatus of FIG. 1 with some components transparent to reveal internal features of the base assembly.

The apparatus 10 includes a base assembly 20 having a vibrating platform 22 that is movable between a loading configuration L, as shown in FIGS. 1 through 5, and a packing configuration P, as shown in FIG. 8. Notably, the base assembly 20 includes a base structure 24 and the vibrating platform 22 is movably coupled to the base structure 24 to enable movement of the vibrating platform 22 between the loading configuration L and the packing configuration P. The base structure 24 may be provided as a frame structure with upstanding guide members 26 for guiding the vibrating platform 22 between the loading configuration L and the packing configuration P. The vibrating platform 22 may be provided as a generally planar structure and may have an upper support surface 28 upon which the herb receptacles 12 rest during filling and which intermittently contacts the herb receptacles 12 during packing. The vibrating platform 22 may be movably coupled to the base structure 24 via a user manipulable lift arrangement 25. The user manipulable lift arrangement 25 may comprise, for example, a plurality of cams 27 and at least one linkage member 29, as shown in FIG. 11, which are manipulable by a user via a handle or other user interface to selectively move the vibrating platform 22 between the loading configuration L and the packing configuration P.

The apparatus 10 further includes a holding tray 30 positionable over the base assembly 20. The holding tray 30 includes a plurality of holding tray apertures 32 each sized to receive a respective one of the herb receptacles 12 and to encircle the herb receptacle 12 at an intermediate location along a longitudinal length thereof, as shown, for example, in FIG. 5. The holding tray apertures 32 may be cylindrical and may pass completely through the holding tray 30. The holding tray apertures 32 may have a cross-sectional profile that is slightly larger than the herb receptacle 12 at an intermediate location such that there is some play or space between the holding tray 30 and the herb receptacle 12 when in the vibrating platform 22 is in the loading configuration L. In addition, each holding tray aperture 32 may be sized to engage a portion of the herb receptacle 12 at a location above the intermediate location when lifting the holding tray 30 with the herb receptacles 12 received therein. In this manner, the holding tray 32 can be lifted slightly to engage the herb receptacles 12 and then carried to a different location with the herb receptacles 12 for further processing. As such, the holding tray 30 may independently support the herb receptacles 12 when removed from the base assembly 20.

The holding tray 30 may be a generally planar structure and may be supported on or by a plurality of upstanding legs 36 that space the holding tray 30 above a support surface upon which the apparatus is used. The holding tray 30 may be held offset from the base assembly 20 by the upstanding legs 36. The holding tray 30 and upstanding legs 36 may collectively straddle the base assembly 20. In this manner, the holding tray 30 may be positioned over the base assembly 20 to operate in conjunction with the base assembly 20 but without making physical contact therewith.

The apparatus 10 may further include a loading tray 40 removably coupled to the holding tray 30. The loading tray 40 includes a plurality of loading tray apertures 42 each sized to receive a respective one of the herb receptacles 12 and to encircle the herb receptacle 12 at an upper location along a longitudinal length of the herb receptacle 12. The loading tray apertures 32 may be cylindrical and pass completely through the loading tray 30. The loading tray apertures 32 may have a cross-sectional profile that is slightly larger than the herb receptacle 12 at the upper location such that there is some play or space between the loading tray 40 and the herb receptacle 12 when in the vibrating platform 22 is in the loading configuration L. Each loading tray aperture 42 may be sized to closely encircle the herb receptacle 12 at the upper location along the longitudinal length of the herb receptacle 12 to minimize an amount of herb material bypassing the herb receptacle 12 during filling.

The loading tray 40 may be a generally planar structure and may be supported on a plurality of upstanding legs or projections that space the loading tray 40 above the holding tray 30. Such upstanding legs or projections may be an extension of the upstanding legs 36 that support the holding tray 30 in the elevated position above the base assembly 20. The loading tray 40 may be removably supported above and spaced apart from the holding tray 30 by the upstanding legs or projections.

In a fully assembled state, the loading tray apertures 42 are aligned coaxially with the holding tray apertures 32 via a plurality of alignment guides, which may comprise or consist of the aforementioned upstanding legs or projections. The loading tray 40 may be spaced apart from the holding tray 30 such that a mid-section of the herb receptacles 12 are visible when filling and packing the herb receptacles 12 with the herb material 14, as shown, for example, in FIG. 8.

The apparatus 10 may further include a metering device 50 removably coupled to the loading tray 40. The metering device 50 may include a plurality of metering cavities 54 for receiving a respective dose of the herb material 14, the metering device 50 being movable relative to the loading tray 40 to enable the respective dose of the herb material 14 to be selectively deposited in a respective herb receptacle 12 when moving the metering device 50 from a fill configuration, in which the metering cavities 54 are isolated from internal cavities of the herb receptacles 12, to a deposit configuration, in which the metering cavities 50 are open to the internal cavities of the herb receptacles 12. For this purpose, the metering device 50 may include a gate structure 52 which is slidable relative to the loading tray 40 to enable the respective dose of the herb material 14 to be selectively deposited into the respective herb receptacle 12 when moving from the fill configuration to the deposit configuration. The metering device 50 may be removably supported on the loading tray 40 to enable removal of the metering device 50 from the loading tray 40 prior to packing the herb receptacles 12 with the herb material 14. The metering device 50 may be configured, for example, such that the gate structure 52 is positionable on the loading tray 40 within a framework of upstanding sidewalls thereof. Clearance may be provided between the gate structure 52 and the framework of the loading tray 40 such that the user can move the gate structure 52 back and forth on the loading tray 40 to dose herb material 14 into the herb receptacles 12.

The metering cavities 54 of the gate structure 52 may be sized to provide a desired dose amount, such as, for example, ½ gram of herb material 14, with each deposit of herb material 14 into the herb receptacles 12. In some instances, a supplemental metering plate positionable on the metering device 50 may be provided to adjust a dose volume of the herb material 14 to be deposited in the herb receptacles 12. The supplemental metering plate may include, for example, a plurality of metering apertures alignable with the metering cavities 54 of the metering device 50 to effectively increase a dose volume of the metering cavities 54. In other instances, a kit comprising various interchangeable gate structures 52 with different capacity metering cavities 54 may be provided so that a user may select a desired dose volume of the herb material to be deposited in the herb receptacles 12 from among the interchangeable gate structures 52.

Figure 1:
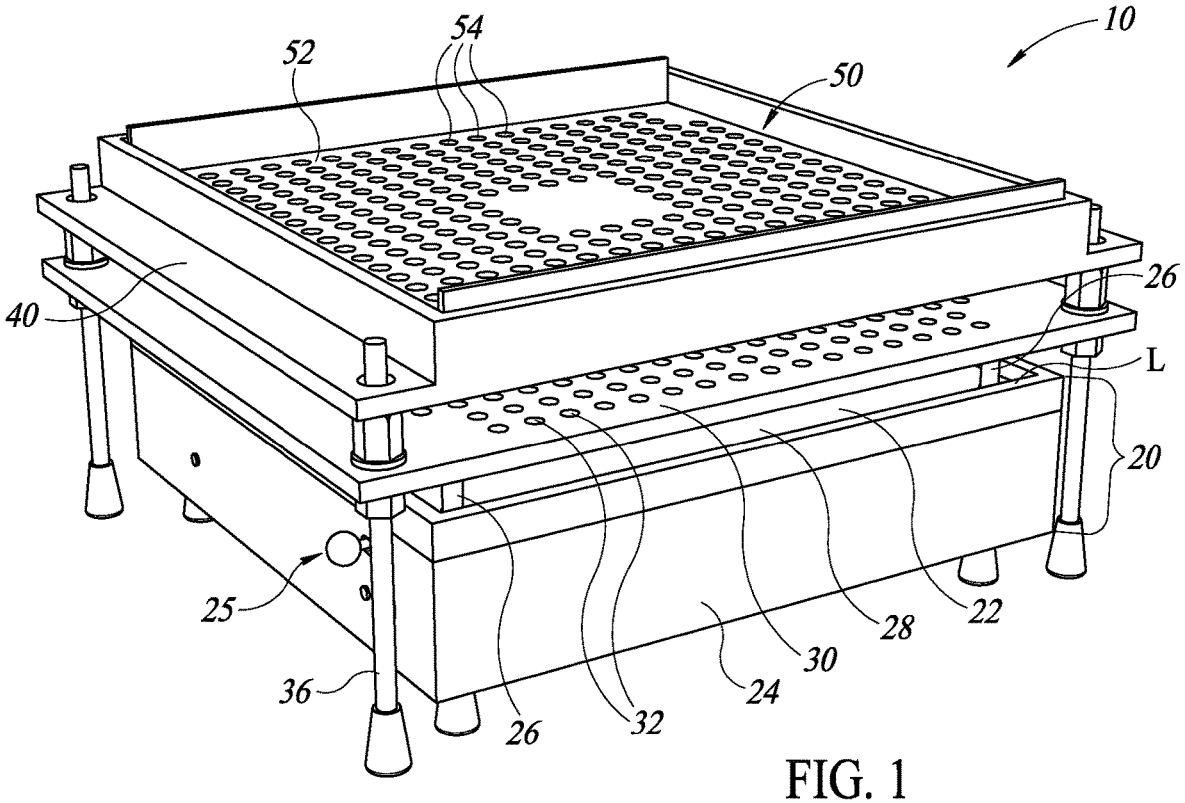
FIG. 1 shows a perspective view of an apparatus, according to one example embodiment, for filling and packing herb receptacles with herb material from one viewpoint.
Figure 2:
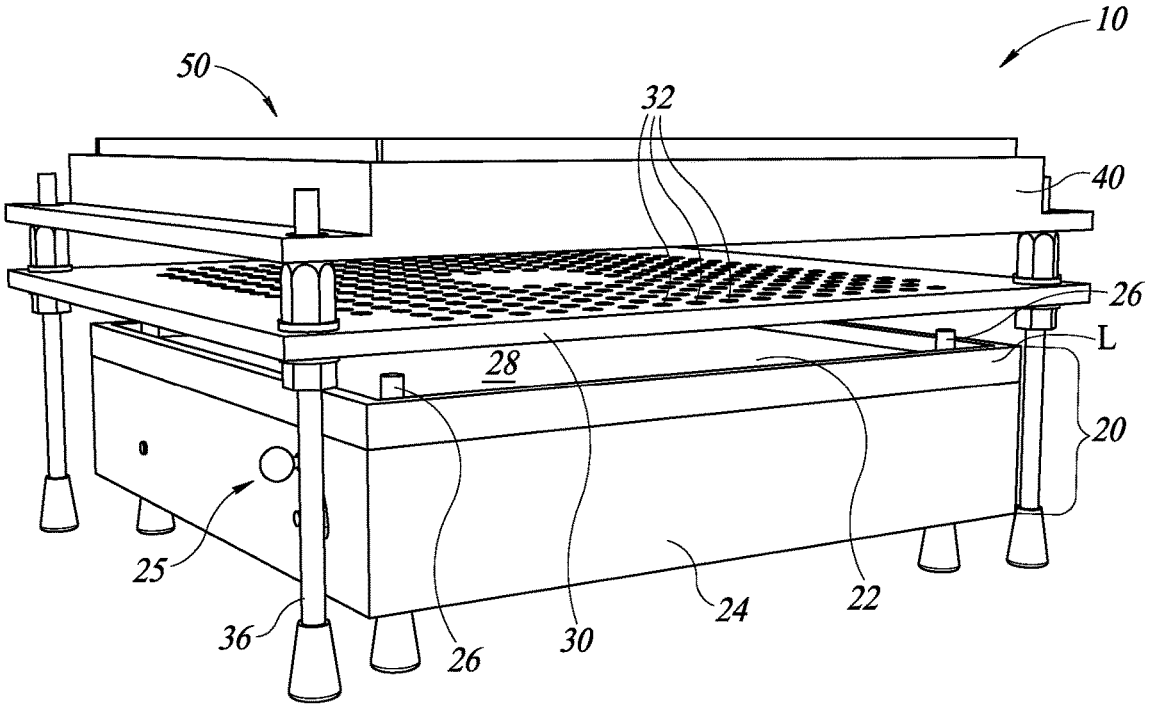
FIG. 2 shows a perspective view of the apparatus of FIG. 1 from another viewpoint.
Figure 3:
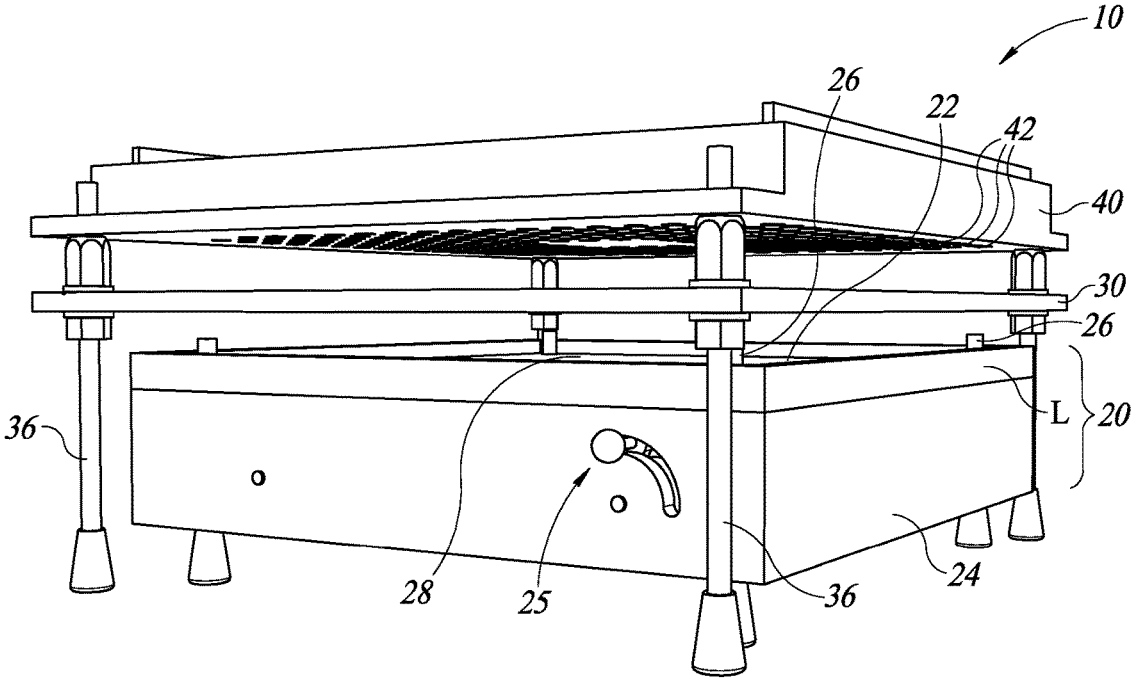
FIG. 3 shows a perspective view of the apparatus of FIG. 1 from yet another viewpoint.
Figure 4:
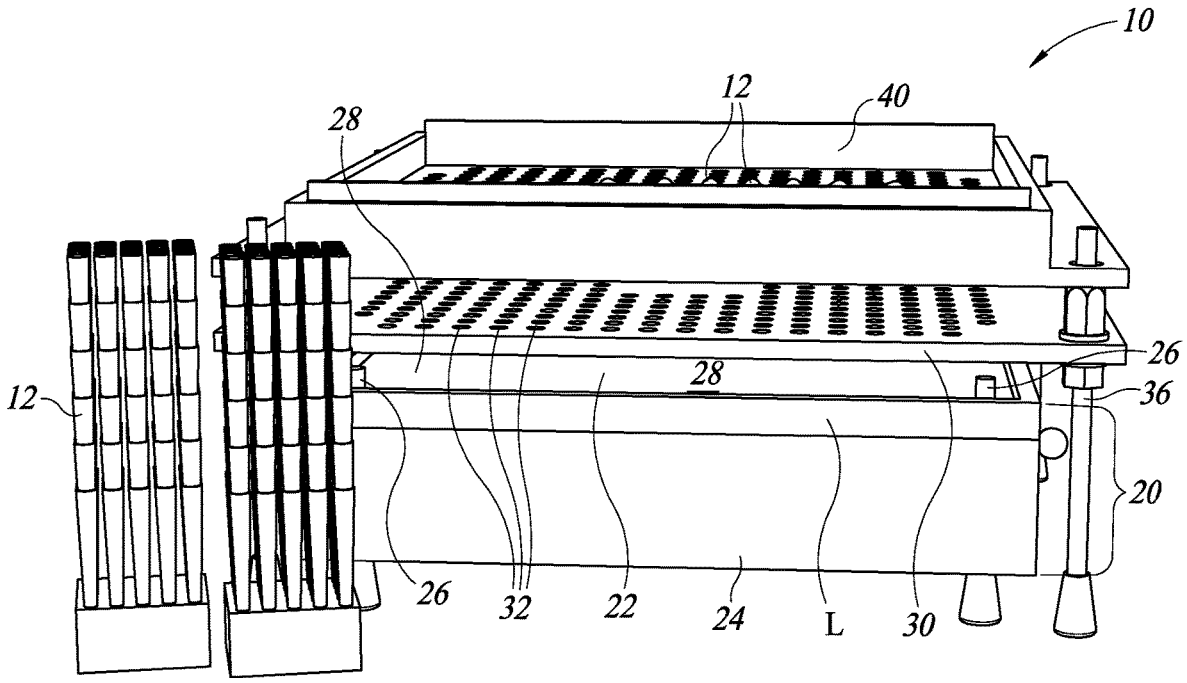
FIG. 4 shows a perspective view of the apparatus of FIG. 1 from yet another viewpoint, along with a plurality of herb receptacles which may be loaded in the apparatus for filling and packing.
Figure 5:
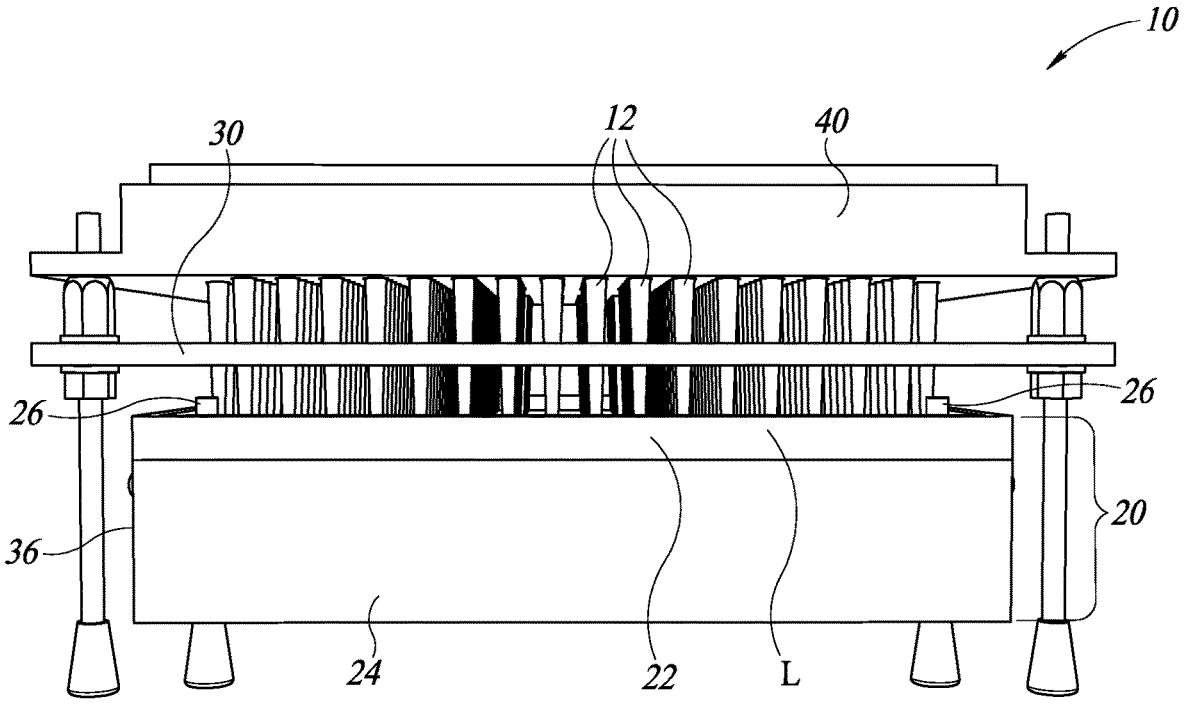
FIG. 5 shows a front perspective view of the apparatus of FIG. 1 loaded with a plurality of herb receptacles.
Figure 6:
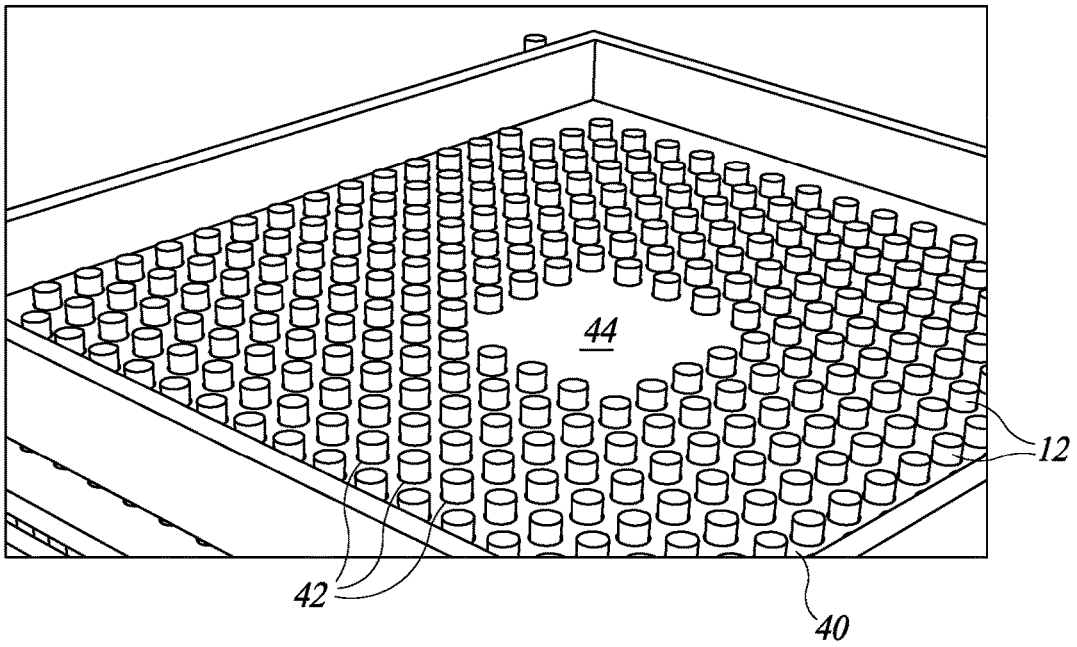
FIG. 6 shows an enlarged perspective view of the apparatus of FIG. 1 loaded with the plurality of herb receptacles, and wherein the herb receptacles are shown lifted in a packing position.
Figure 7:
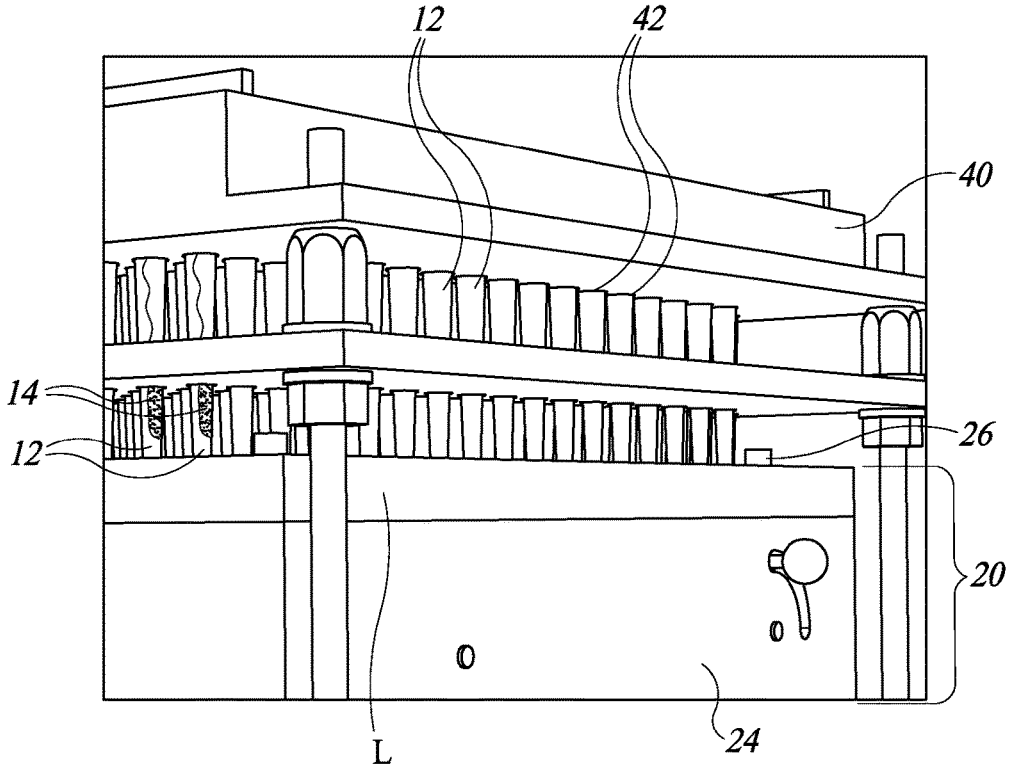
FIG. 7 shows an enlarged perspective view of the apparatus of FIG. 1 loaded with the plurality of herb receptacles, and wherein the herb receptacles are shown filled with a dose of herb material.

With reference to FIG. 5, when the vibrating platform 22 of the base assembly 20 is in the loading configuration L, the loading tray 30 and holding tray 40 may support the herb receptacles 12 with terminal ends of the herb receptacles 12 in contact with the vibrating platform 22 and with loading ends of the herb receptacles 12 at or below an upper surface 44 of the loading tray 40. In this manner, upper ends of the herb receptacles 12 sit at or below the upper surface 44 of the loading tray 40 so as to not interfere with operation of the metering device 50 when loading the herb receptacles 12 with herb material 14. Conversely, with reference to FIG. 6, when the vibrating platform 22 of the base assembly 20 is in the packing configuration P, the loading tray 30 and holding tray 40 may support the herb receptacles 12 with terminal ends of the herb receptacles 12 in contact with the vibrating platform 22 and with loading ends of the herb receptacles above the upper surface 44 of the loading tray 40. In this manner, upper ends of the herb receptacles 12 may protrude above the upper surface 44 of the loading tray 40 when packing the herb material 14. The vibrating platform 22 is configured to move the herb receptacles 12 relative to the holding tray 40 and the loading tray 30 when moving from the loading configuration L to the packing configuration P to lift the herb receptacles 12 during packing of the herb receptacles 12.

To assist in packing the herb material 14, the base assembly 20 may include an electric vibrator 29 fixed to the vibrating platform 22 to enable selective vibration of the vibrating platform 22 during packing of the herb receptacles 12. In some instances, a frequency and/or an intensity of the electric vibrator 29 may be variable to adjust a packing quality of the herb receptacles 12. The electric vibrator 29 may be, for example, an OLI™ brand standard electric vibrator, sold under the part number MVE 0021 36 115 and available via globalindustrial.com. In other instances, other vibrating means or vibrating devices may be provided for causing vibratory motion of the vibrating platform 22 during packing of the herb receptacles 12.

In view of the above, and with reference to FIGS. 12A through 12K, it will be appreciated that various methods of filling and packing herb receptacles with herb material may be provided.

Figure 12A:
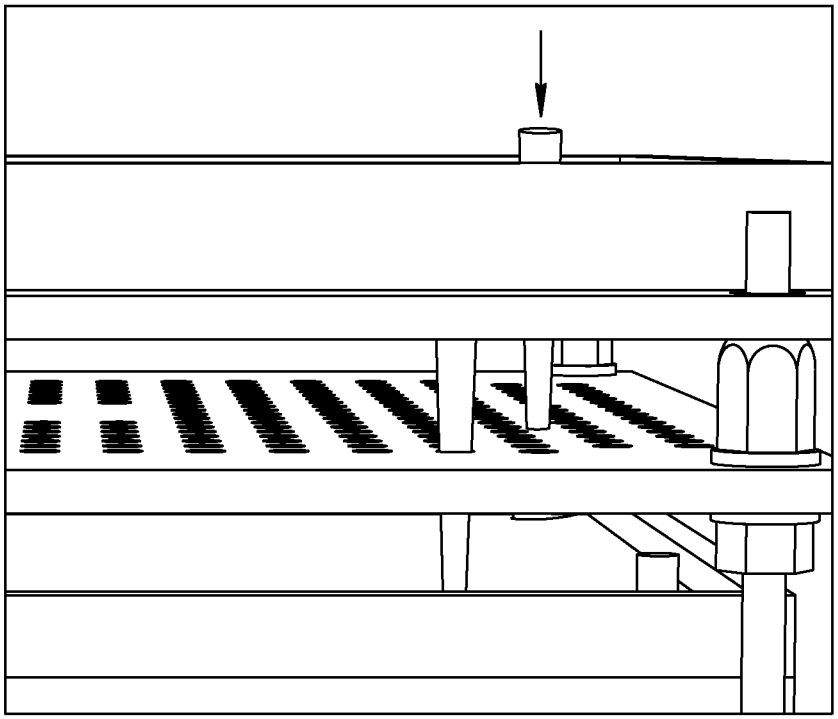
FIGS. 12A through 12K provide a sequence of images of an apparatus for filling and packing herb receptacles with herb material throughout use thereof and illustrate aspects of methods of filling and packing herb receptacles according to embodiments of the present invention.

For instance, as shown in FIG. 12A, a method of filling and packing herb receptacles 12 with herb material 14 may start with a user loading herb receptacles 12 (e.g., paper cones) into the loading tray apertures 42 of the loading tray 40 and the holding tray apertures 32 of the holding tray 30 of the apparatus 10 shown in FIGS. 1 through 11.

Figure 12B:
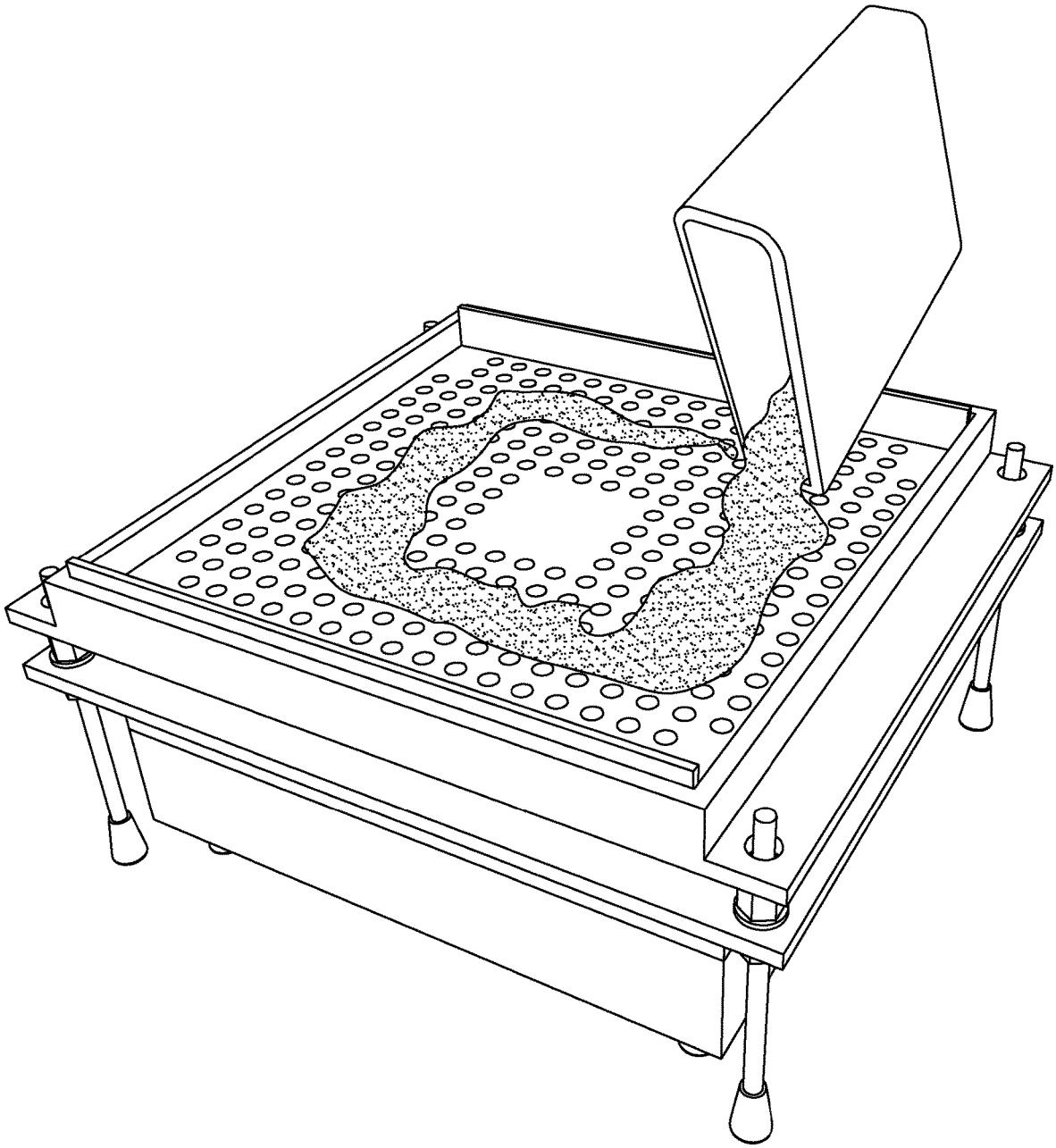
Figure 12C:
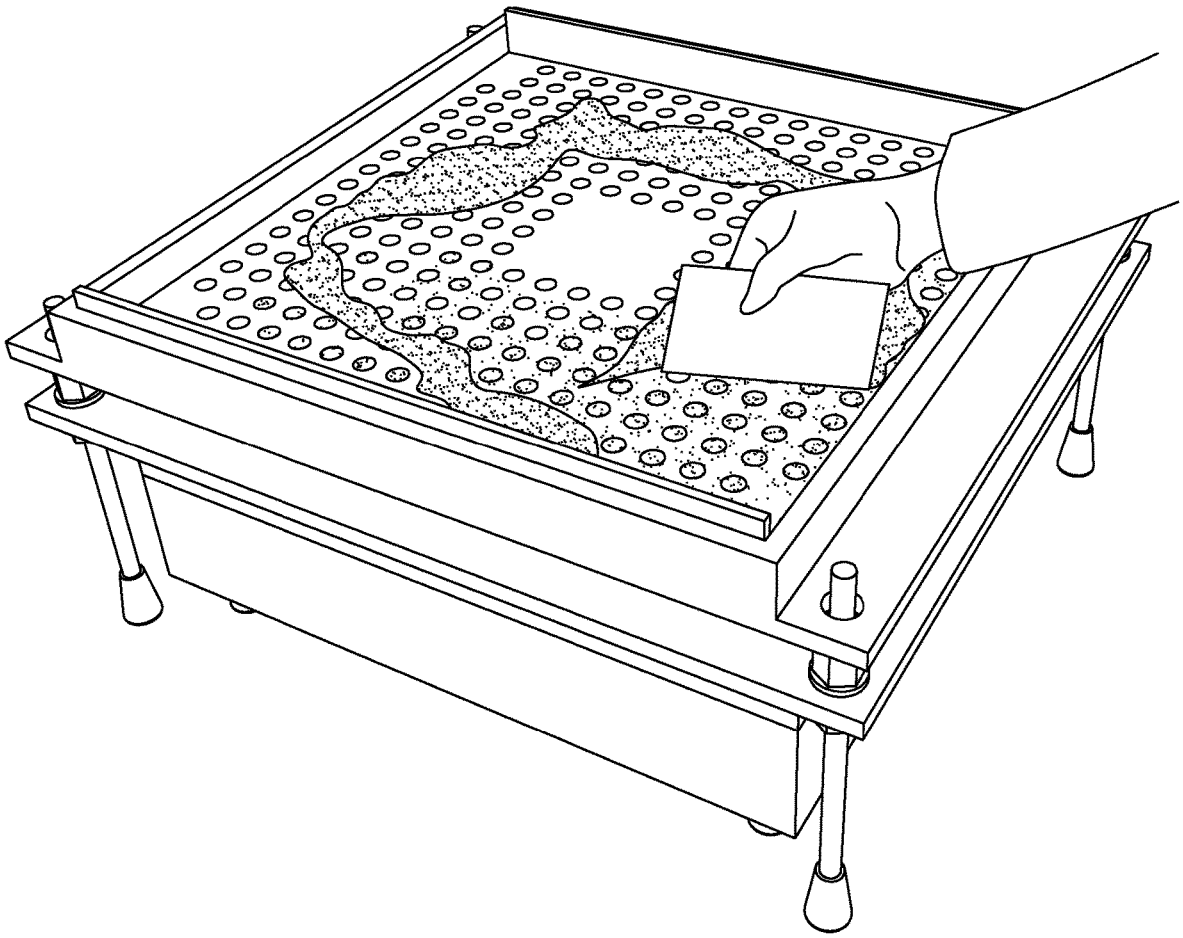

As shown in FIG. 12B, the method may continue with positioning the metering device 50 on the loading tray 40 and filling the metering cavities 54 of the movable gate structure 52 of the metering device 50 with herb material 14. Such filling may include using a screed device to spread the herb material 14 into each of the metering cavities 54 of the movable gate structure 50, as shown in FIG. 12C.

Figure 12D:
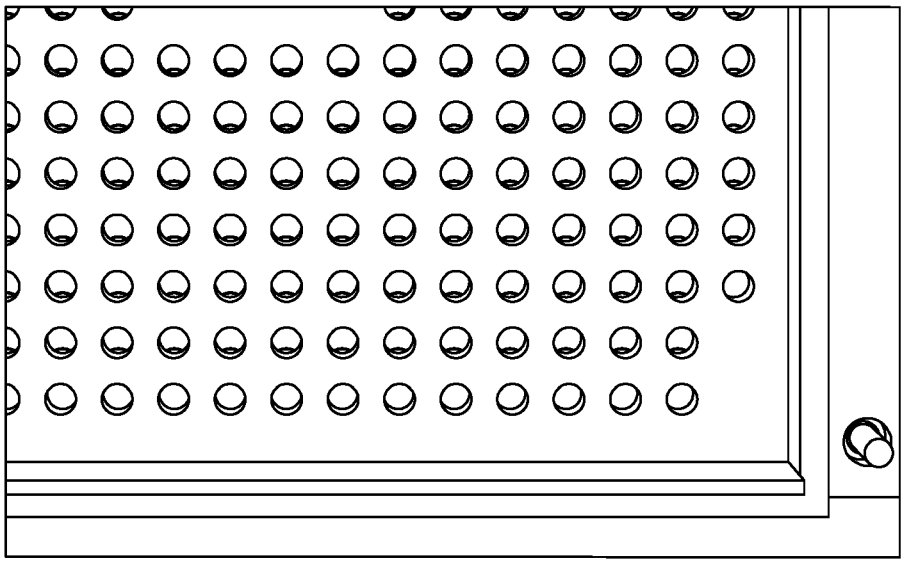

Then, as can be appreciated in FIG. 12D, the gate structure 52 may be actuated to align the metering cavities 54 with the loading tray apertures 42 to enable the dose of herb material 14 in the metering cavities 54 to fall into the herb receptacles 12. Notably, the vibrating platform 22 of the base assembly 20 is in the loading configuration L when dosing the herb material 14 into the herb receptacles 12. Note: no herb material is shown in FIG. 12D so as to better illustrate the movement of the metering device 50.

Figure 12E:
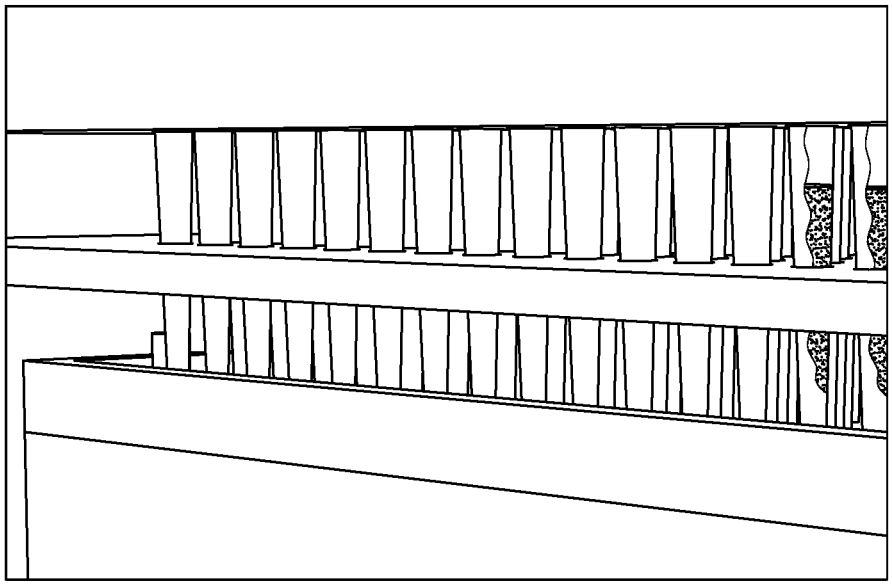

As shown in FIG. 12E, herb material 14 drops into and fills the herb receptacles 12 via operation of the metering device 50, which can be confirmed visually given the structural arrangement of the loading tray 40 and the holding tray 30.

Figure 12F:
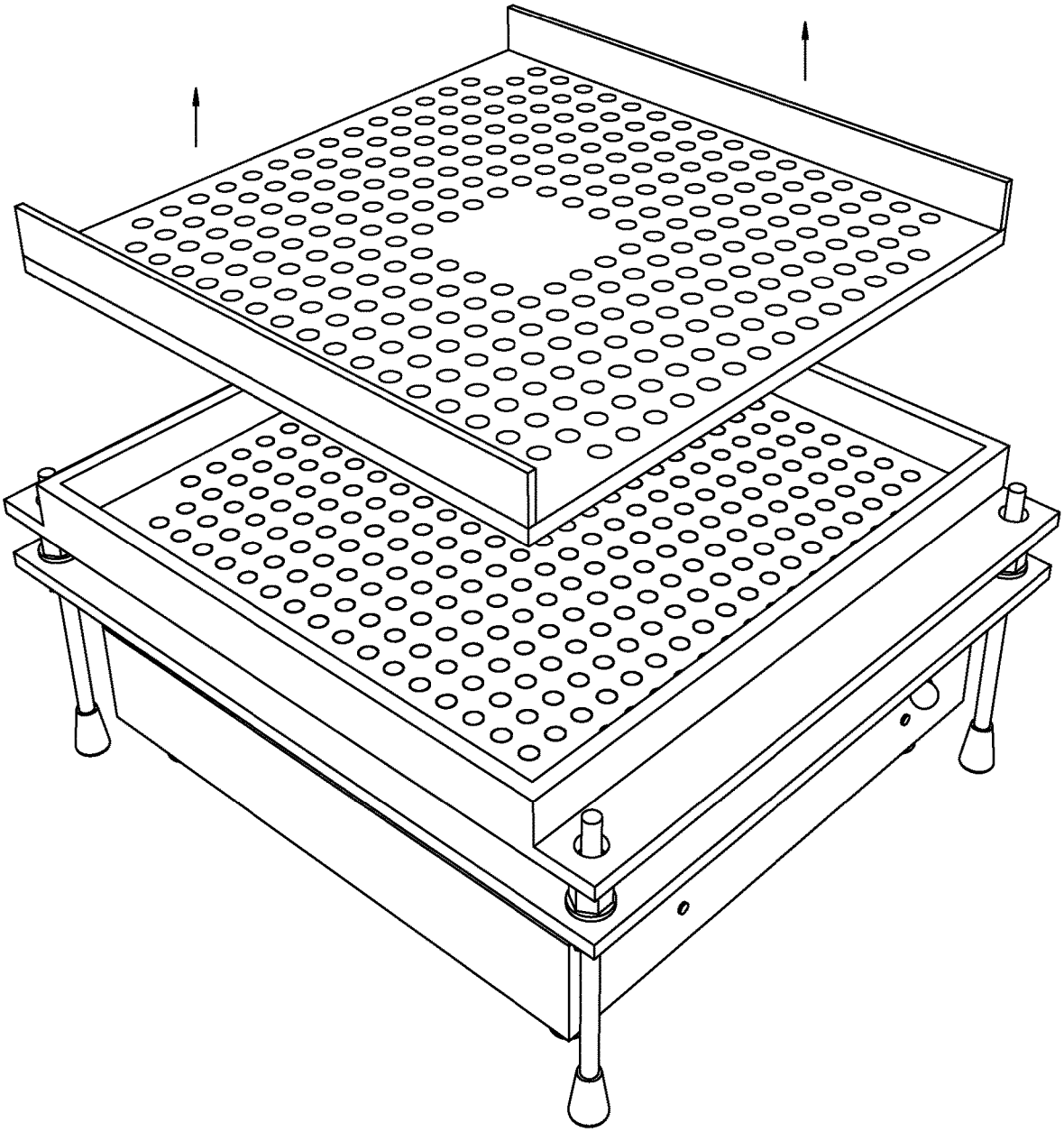

After dosing the herb material 14 into the herb receptacles 12, the metering device 50 may be removed from the loading tray 40, as shown in FIG. 12F.

Figure 12G:
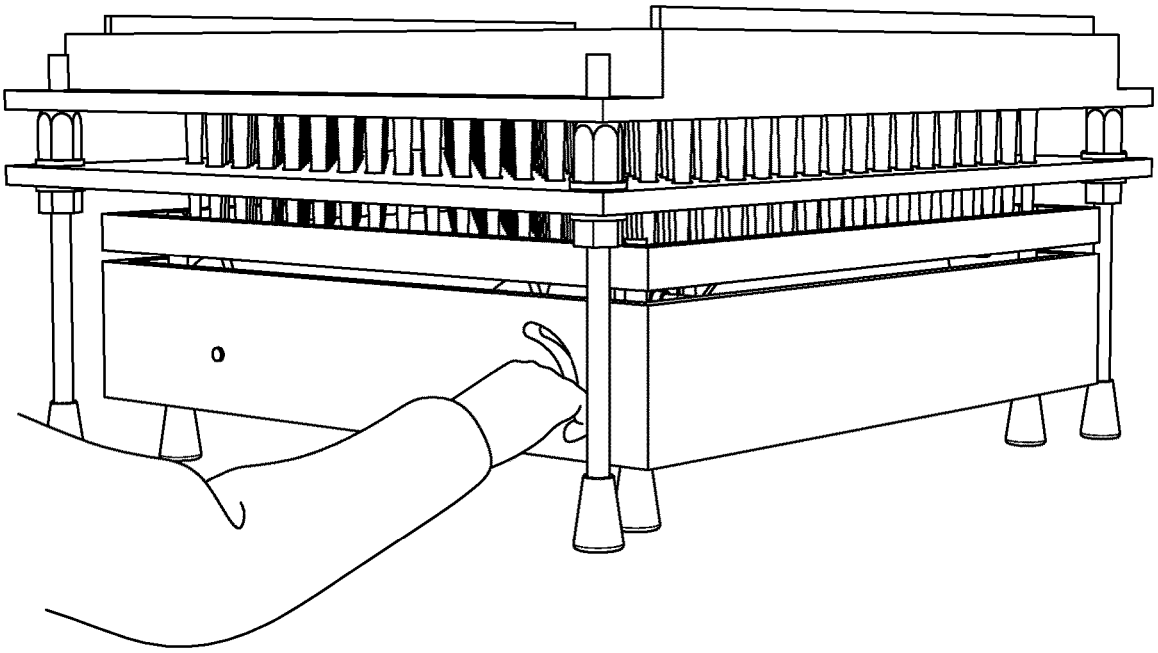

Next, the user may move the vibrating platform 22 from the loading configuration L to the packing configuration P to lift the herb receptacles 12 relative to the holding tray 30 and the loading tray 40, as shown in FIG. 12G.

Figure 12H:
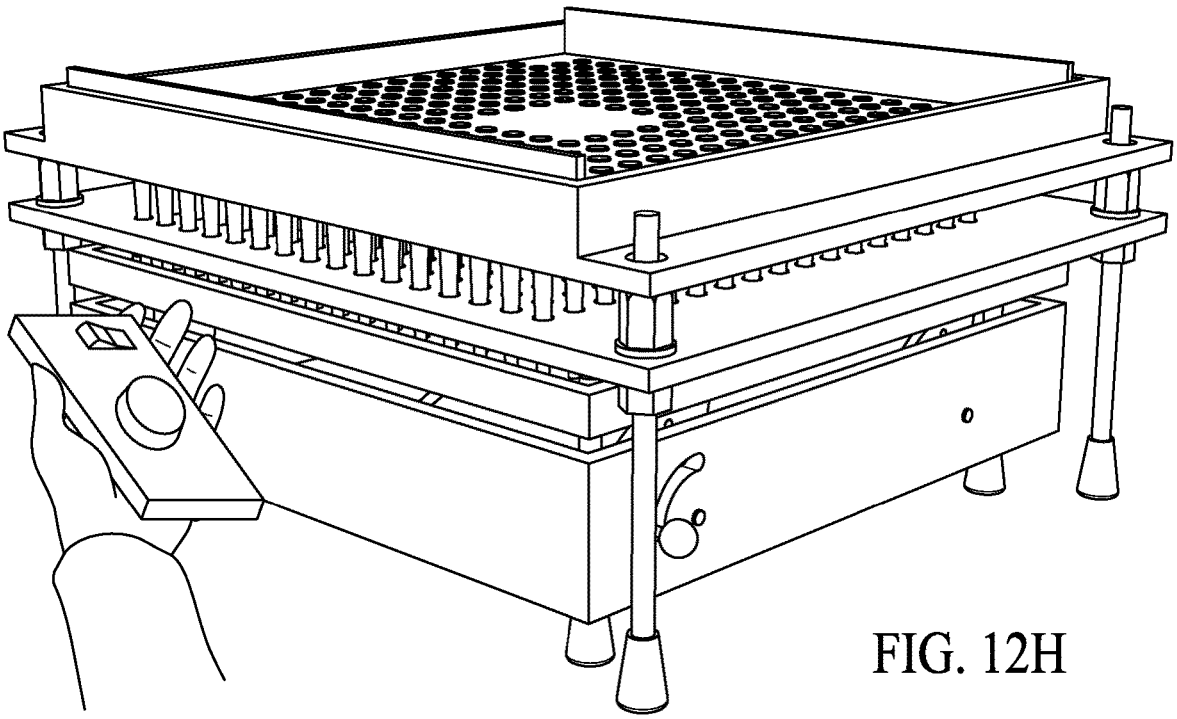

With the vibrating platform 22 in the packing configuration P, the user may activate the electric vibrator 29 and adjust vibration settings thereof to pack the herb material 14 in the herb receptacles 12, as shown in FIG. 12H. Duration, frequency and/or intensity of the vibratory motion of the vibrating platform 22 may be adjusted to provide a desired pack.

Figure 12I:
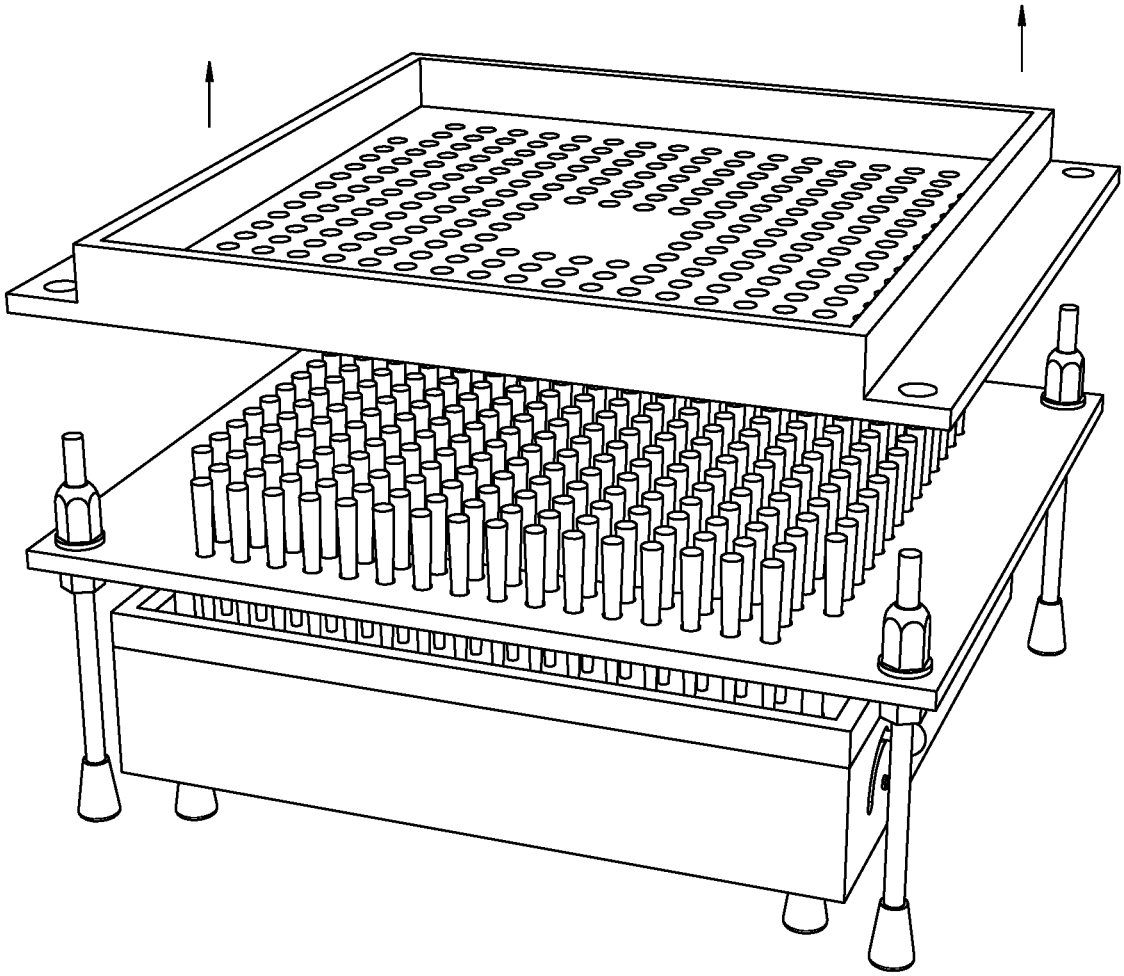

After filling the herb receptacle to the desired level and packing, the loading tray 40 may be removed to free upper ends of the herb receptacles 12, as shown in FIG. 12I.

Figure 12J:
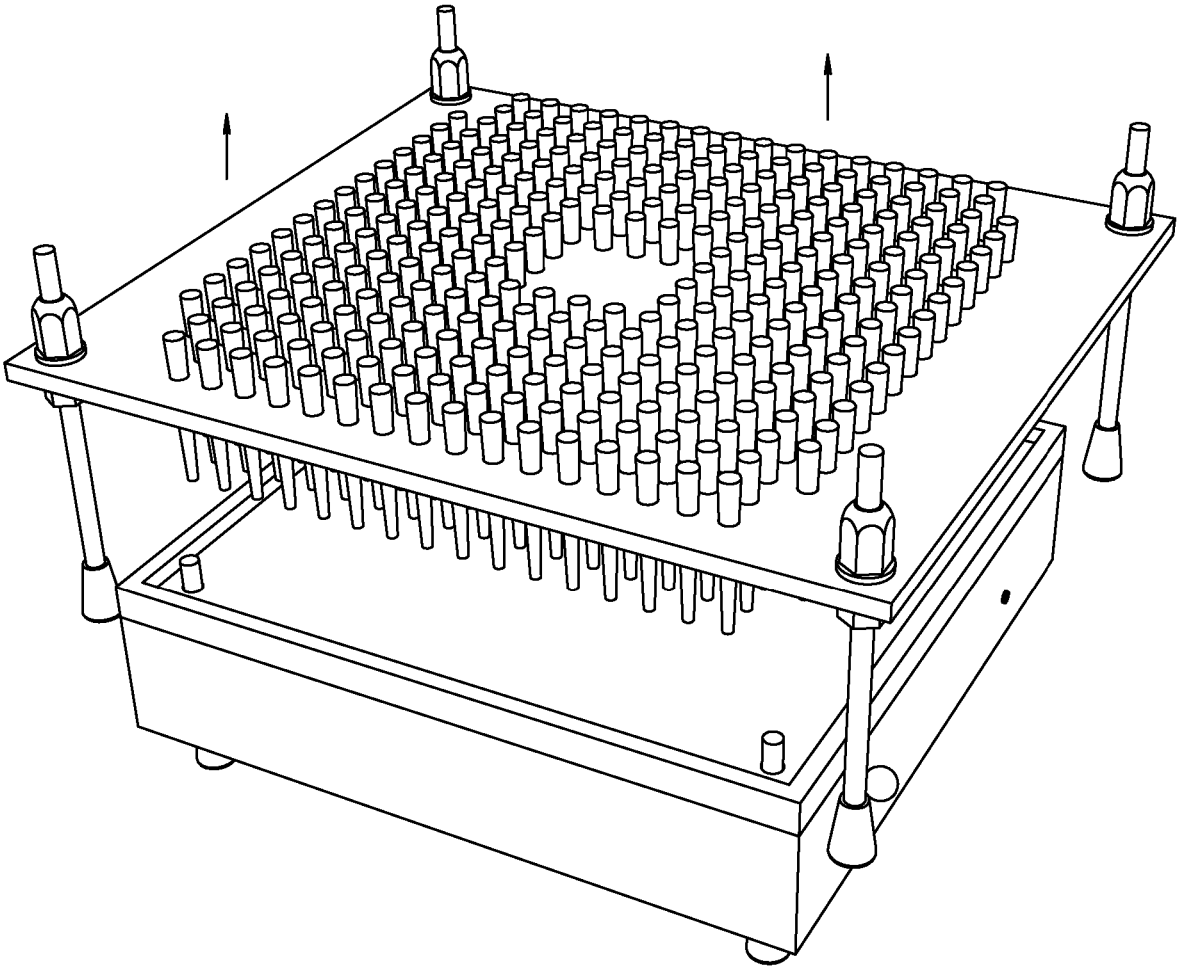
Figure 12K:
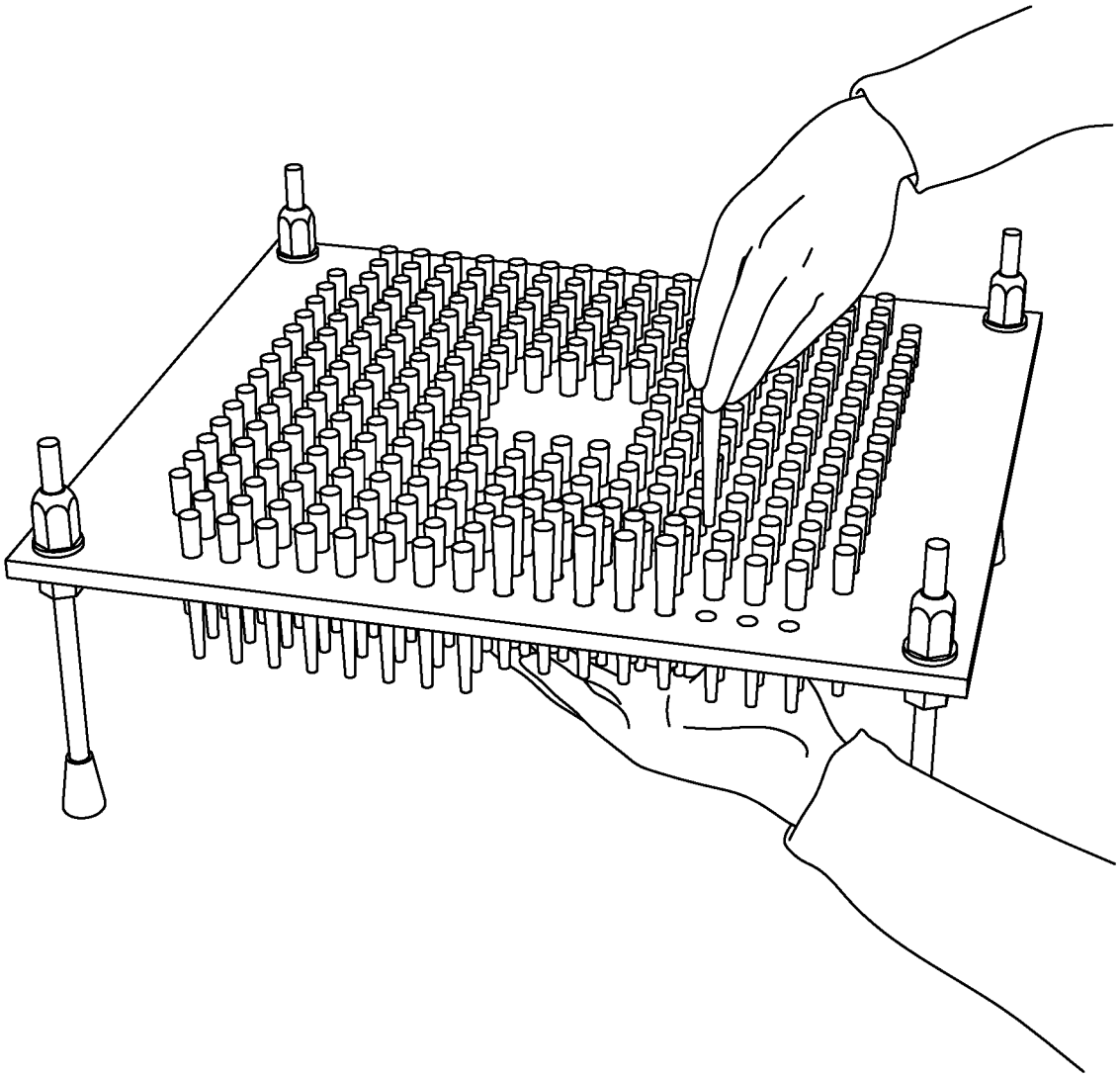

Then, the holding tray 30 with filled and packed herb receptacles 12 therein may be removed from the base assembly 20 and relocated, if desired, for further processing, as shown in FIG. 12J. Such further processing may include, for example, removing the filled and packed herb receptacles 12 from the holding tray 30, as shown in FIG. 12K, and closing an upper end thereof.

As can be appreciated from the above, a method of filling and packing herb receptacles with herb material according to one example embodiment may include: supporting the herb receptacles in space on a vibrating platform with the aid of a support structure having a plurality of holding apertures each sized to receive a respective one of the herb receptacles and to encircle the herb receptacle at an intermediate location along a longitudinal length of the herb receptacle; dosing herb material into the herb receptacles; repositioning the vibrating platform from a loading configuration to a packing configuration to lift the herb receptacles with the herb material relative to the support structure; and packing the herb receptacles with the herb material with the vibrating platform in the packing configuration.

The method may further include, during the dosing of the herb material into the herb receptacles, supporting the herb receptacles in space on the vibrating platform with the further aid of a loading tray. Dosing the herb material into the herb receptacles may include, for example, filling a plurality of metering cavities of a metering device with the herb material and translating the metering device relative to the loading tray to expose the metering cavities to internal cavities of the herb receptacles. The method may further include removing the metering device from the loading tray prior to repositioning the vibrating platform from the loading configuration to the packing configuration. The method may further include, after packing the herb receptacles with the herb material, removing the loading tray from support of the herb receptacles and relocating the support structure with the herb receptacles with the packed herb material supported therein for further processing. The method may also include adjusting a packing quality of the herb material in the herb receptacles by modifying a frequency and/or an intensity of vibratory motion of the vibrating platform during the packing of the herb receptacles.

Although the apparatuses and methods described herein are discussed primarily in the context of packing herb receptacles with herb material, it is appreciated that aspects of the apparatuses and methods described herein may be used for other purposes and to fill and pack receptacles with various fill materials.

Moreover, aspects and features of the various embodiments described above may be combined to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An apparatus for filling and packing herb receptacles with herb material, the apparatus comprising:

a base assembly having a vibrating platform that is, apart from vibratory movement, further movable via a user manipulable lift arrangement between a loading configuration, in which the vibrating platform is positioned at a first height for filling of the herb receptacles, and a packing configuration, in which the vibrating platform is positioned at a second height that is greater than the first height for packing the herb receptacles via the vibratory movement of the vibrating platform, the lift arrangement being configured to retain the vibrating platform at the second height during the packing of the herb receptacles;

a holding tray positionable over the base assembly and having a plurality of holding tray apertures each sized to receive a respective herb receptacle and to encircle the herb receptacle at an intermediate location along a longitudinal length of the herb receptacle; and a loading tray removably coupled to the holding tray and having a plurality of loading tray apertures each sized to receive a respective herb receptacle and to encircle the herb receptacle at an upper location along a longitudinal length of the herb receptacle.

2. The apparatus of claim 1, further comprising:

a metering device removably coupled to the loading tray and having a plurality of metering cavities for receiving a respective dose of the herb material, the metering device being movable relative to the loading tray to enable the respective dose of the herb material to be selectively deposited in a respective herb receptacle when moving the metering device from a fill configuration, in which the metering cavities are isolated from internal cavities of the herb receptacles, to a deposit configuration, in which the metering cavities are open to the internal cavities of the herb receptacles.

3. The apparatus of claim 2 wherein the metering device includes a gate structure that is slidable relative to the loading tray to enable the respective dose of the herb material to be selectively deposited into the respective herb receptacle when moving from the fill configuration to the deposit configuration.

4. The apparatus of claim 2 wherein the metering device is removably supported on the loading tray to enable removal of the metering device from the loading tray prior to packing the herb receptacles with the herb material.

5. The apparatus of claim 2, further comprising:

a supplemental metering plate positionable on the metering device to adjust a dose volume of the herb material to be deposited in the herb receptacles, the supplemental metering plate including a plurality of metering apertures alignable with the metering cavities of the metering device.

6. The apparatus of claim 1 wherein the base assembly includes a base structure and the vibrating platform is movably coupled to the base structure to enable movement of the vibrating platform via the user manipulable lift arrangement between the loading configuration and the packing configuration.

7. The apparatus of claim 6 wherein the user manipulable lift arrangement includes a plurality of cams and at least one linkage member.

8. The apparatus of claim 1 wherein, when the vibrating platform of the base assembly is in the loading configuration, the loading tray and holding tray support the herb receptacles with terminal ends of the herb receptacles in contact with the vibrating platform and with loading ends of the herb receptacles at or below an upper surface of the loading tray.

9. The apparatus of claim 1 wherein, when the vibrating platform of the base assembly is in the packing configuration, the loading tray and holding tray support the herb receptacles with terminal ends of the herb receptacles in contact with the vibrating platform and with loading ends of the herb receptacles above the upper surface of the loading tray.

10. The apparatus of claim 1 wherein the vibrating platform is configured to move the herb receptacles relative to the holding tray and the loading tray when moving from the loading configuration to the packing configuration.

11. The apparatus of claim 1 wherein the base assembly includes an electric vibrator fixed to the vibrating platform to enable selective vibration of the vibrating platform during packing of the herb receptacles.

12. The apparatus of claim 11 wherein a frequency and/or an intensity of the electric vibrator is variable to adjust a packing quality of the herb receptacles.

13. The apparatus of claim 1 wherein the loading tray is removably supported above and spaced apart from the holding tray.

14. The apparatus of claim 1 wherein the loading tray apertures are aligned coaxially with the holding tray apertures via a plurality of alignment guides.

15. The apparatus of claim 1 wherein the loading tray is spaced apart from the holding tray such that a mid-section of the herb receptacles are visible when filling and packing the herb receptacles with the herb material.

16. The apparatus of claim 1 wherein each loading tray aperture is sized to closely encircle the herb receptacle at the upper location along the longitudinal length of the herb receptacle to minimize an amount of herb material bypassing the herb receptacle during filling.

17. The apparatus of claim 1 wherein each holding tray aperture is sized to engage a portion of the herb receptacle at a location above the intermediate location when lifting the holding tray with the herb receptacles received therein.

18. The apparatus of claim 1 wherein the holding tray is configured to independently support the herb receptacles when removed from the base assembly.

19. A method of filling and packing herb receptacles with herb material, the method comprising:

supporting the herb receptacles in space on a vibrating platform with the aid of a support structure having a plurality of holding apertures each sized to receive a respective one of the herb receptacles and to encircle the herb receptacle at an intermediate location along a longitudinal length of the herb receptacle;

dosing herb material into the herb receptacles;

repositioning the vibrating platform using a user manipulable lift arrangement from a loading configuration, in which the vibrating platform is positioned at a first height for filling of the herb receptacles, to a packing configuration, in which the vibrating platform is positioned at a second height that is greater than the first height for packing the herb receptacles via vibratory movement of the vibrating platform, to lift the herb receptacles with the herb material relative to the support structure; and packing the herb receptacles with the herb material with the vibrating platform maintained in the packing configuration.

20. The method of claim 19, further comprising:

during the dosing of the herb material into the herb receptacles, supporting the herb receptacles in space on the vibrating platform with the further aid of a loading tray.

21. The method of claim 20 wherein dosing the herb material into the herb receptacles includes filling a plurality of metering cavities of a metering device with the herb material and translating the metering device relative to the loading tray to expose the metering cavities to internal cavities of the herb receptacles.

22. The method of claim 21, further comprising:

removing the metering device from the loading tray prior to repositioning the vibrating platform from the loading configuration to the packing configuration.

23. The method of claim 20, further comprising:

after packing the herb receptacles with the herb material, removing the loading tray from support of the herb receptacles and relocating the support structure with the herb receptacles with the packed herb material supported therein for further processing.

24. The method of claim 19, further comprising:

adjusting a packing quality of the herb material in the herb receptacles by modifying a frequency and/or an intensity of vibratory motion of the vibrating platform during the packing of the herb receptacles.

* * * * *